United States Patent [19]

Röck et al.

[11] 4,411,045

[45] Oct. 25, 1983

[54] HINGE

[75] Inventors: Erich Röck, Höchst; Klaus Brüstle, Lauterach, both of Austria

[73] Assignee: Julius Blum Gesellschaft m.b.H., Höchst, Austria

[21] Appl. No.: 313,976

[22] Filed: Oct. 22, 1981

[30] Foreign Application Priority Data

Nov. 14, 1980 [AT] Austria ..... 5604/80

[51] Int. Cl.[3] ..... E05D 7/04

[52] U.S. Cl. ..... 16/243; 16/247; 16/248

[58] Field of Search ..... 16/247, 248, 237, 243

[56] References Cited

U.S. PATENT DOCUMENTS 959,001 5/1910 Tritsch ..... 16/243

1,067,114 7/1913 Hixson ..... 16/247

3,229,323 1/1966 Hensgen ..... 16/247

FOREIGN PATENT DOCUMENTS 462061 3/1937 United Kingdom ..... 16/247

*Primary Examiner*—Mark Rosenbaum

*Attorney, Agent, or Firm*—Wenderoth, Lind & Ponack

[57] ABSTRACT

A hinge for mounting a door swingably on the frame of a piece of furniture includes one mounting member mountable on the door and a second mounting member mountable on the frame. The two members are connected by a hinge pin or by hinge pins and hinge links. Between the member mounted on the frame and the frame itself there is a wedge type intermediate member for adjusting the distance between this mounting member and the face of the frame.

7 Claims, 6 Drawing Figures

HINGE

BACKGROUND OF THE INVENTION

1. Field of the Invention

This invention relates to a hinge for articles of furniture and comprising a first mounting member, e.g. a hinge casing, fastenable to a door of an article of furniture, and a second mounting member, e.g. a hinge arm, fastenable to the body of the article of furniture. The two mounting members are linked to each other by means of one axle or several axles and hinge links. An intermediate member is arranged between the mounting member, which is disposed on the side of the body, and the body of the article of the furniture.

2. Description of the Prior Art

Hinges which allow an adjustment of their position after mounting are frequently used in modern furniture construction, particularly of kitchen and office furniture.

This means that any inaccuracies which occur, when the door has already been mounted on the body of the piece or article of furniture, and which have been caused by the drilling of fastening holes for the mounting member of the hinge on the side of the body or of the door of the piece of furniture, can be compensated so that the door is always in correct position after being mounted.

The possibilities of adjustment, which are required in modern hinges, are direction of the adjustment in the depth of the piece of furniture, adjustment in the direction of the breadth of the door joint and adjustment in the direction of the height of the piece of furniture.

The adjustment in the direction of the depth of the piece of furniture and the adjustment in the direction of the breadth of the door joint are the most important possibilities of adjustment.

The possibility of adjusting the piece of furniture in the direction of the height of the piece of furniture is often not provided. In the three above-mentioned possibilities of adjustment, the mounting member of the hinge on the side of the body, i.e. the so-called hinge arm, is adjusted.

In conventional hinges, the adjustment of the door joint is usually effected by means of a joint adjusting screw mounted in the hinge arm. The screw is positioned relatively closely to the hinge axles and determines the distance of the front end of the oblong hinge arm to the base plate. Thereby, the hinge arm essentially is pivoted around its rear end.

SUMMARY OF THE INVENTION

The present invention relates to a novel joint adjusting arrangement which is particularly suitable for so-called frame hinges.

Bodies of pieces of furniture on which such frame hinges are mounted have a frame in the region of the door, such frame representing the actual supporting element of the body of the piece of furniture in such region. The actual side walls of the body, which are very thin and are not able to carry the door, are externally fastened to the frame.

The hinges are internally fastened to the frame. As the frame in the direction of the depth of the piece of furniture is relatively narrow so that only little space is required, mounting members of the hinge are adapted to extend only slightly into the depth of the piece of furniture. An adjustment of the door joint, which is possible with conventional hinges, is hardly possible.

It is, therefore, the object of this invention to provide an adjustment of the joint for such hinges.

According to the invention, this is achieved by providing the mounting member on the side of the body and the intermediate member with wedge faces resting against each other, by adapting the intermediate member to be movable with respect to such mounting member in the direction of the wedge taper, and by providing a screw extending through a round hole in the mounting member into a slot of the intermediate member, such slot being aligned in the direction of displacement of the intermediate member.

In the hinge according to the invention, the mounting member on the side of the body which practically forms the hinge arm, is alternatively lifted from the mounting face of the frame or lowered thereon, whereby the desired adjustment in the direction of the door joint is obtained.

An advantageous embodiment of the invention provides that the intermediate member has two wedge faces and two slots, and that a screw projecting through the second slot in the intermediate member also extends through a slot in the mounting member.

This embodiment allows a height adjustment as well as a joint adjustment of the hinge. The hinge can, on the side of the body, be pre-mounted by means of the screw extending through the second slot, then the height adjustment may be effected, whereupon a screw is screwed through the round hole in the mounting member into the body of the piece of furniture, i.e. into the frame of the body of the piece of furniture. Then, the mounting member is positioned with respect to height. The adjustment of the joint can then be effected by displacing the intermediate member, such displacement being possible because of the slots provided in the intermediate member in the region of the two screws. After the joint adjustment, the two screws are fastened.

It has proved advantageous in the construction of frame furniture that the intermediate member is displaceable in the direction of the pivoting axle of the hinge.

A further embodiment of the invention provides that the mounting member and the intermediate member are substantially rectangular as viewed outwardly thereof and that the longer sides extend parallel to the pivoting axle of the hinge.

In order to obtain better guiding of the intermediate member with respect to the mounting member, it is provided that projections arranged on the intermediate member rest on the mounting member.

A further embodiment of the invention provides that the mounting member on the side of the body has a central length supporting region for the hinge axle or hinge axles, and opposite end length portions, with the round hole arranged on one side of the supporting portion and the slot of the mounting member on the other side thereof.

The screws are advantageously the fastening screws for the mounting member.

A further embodiment of the invention provides that the mounting member embraces the intermediate member and has a U-shaped configuration.

BRIEF DESCRIPTION OF THE DRAWINGS

In the following the invention will be described in greater detail with reference to the accompanying drawings, by way of example only, and wherein.

DETAILED DESCRIPTION OF THE INVENTION

Figure 1:
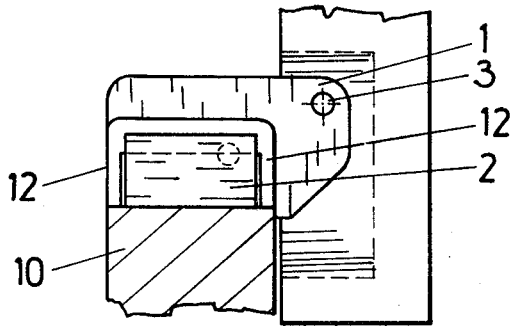
FIG. 1 is a schematic horizontal view, partially in section, of a hinge according to the invention.
Figure 2:
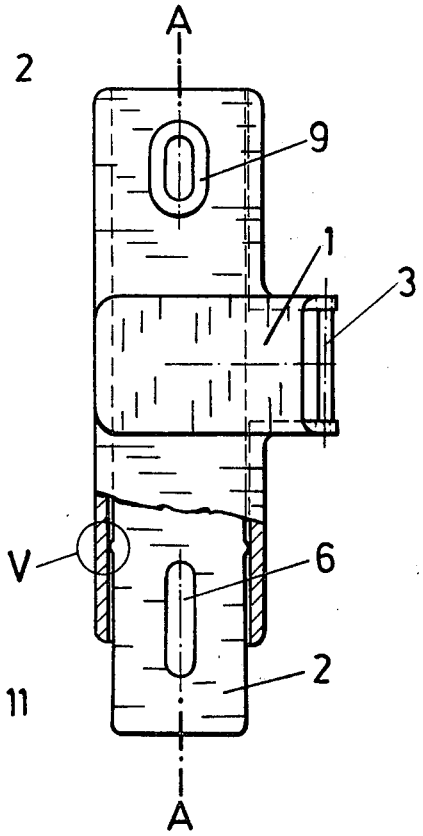
FIG. 2 is a side view, partially in section, of the hinge parts on the side of the body of a piece of furniture.
Figure 5:
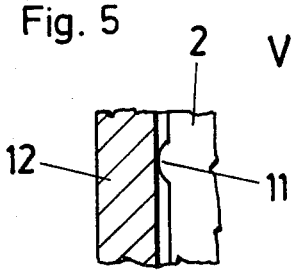
FIG. 5 is an enlarged section of the detail V of FIG. 2.

In the drawings, the hinge casing or mounting member for the door and the means connecting the two mounting members, i.e. hinge axles and hinge links, have not been illustrated in detail as they are of conventional design and are not affected by the narrow of joint adjustment according to the invention.

The hinge parts on the side of the body of an article of furniture comprise a mounting member 1 which is mounted on the side of the body, which forms hinge arms for the hinge and carries a hinge axle or axles 3, and an intermediate member 2.

The intermediate member 2 is embraced by the mounting member 1 which has a U-shaped configuration. The intermediate member 2 as well as the mounting member 1 are retained by two screws 4, 5.

Screws 4, 5 may, however, be replaced by other retaining means, e.g. dowel pins.

The intermediate member 2 is provided with two wedge faces 2', and the mounting member 1 with two corresponding wedge faces 1' resting on the wedge faces 2' of the intermediate member in the mounted position.

The screws 4, 5 extend through the mounting member 1 as well as through the intermediate member 2.

The intermediate member 2 in the region of the screw 4 is provided with a slot 6 and in the region of the screw 5 is provided with a slot 7.

The mounting member 1 in the region of the screw 4 has a round hole 8 and in the region of screw 5 has a slot 9.

Figure 3:
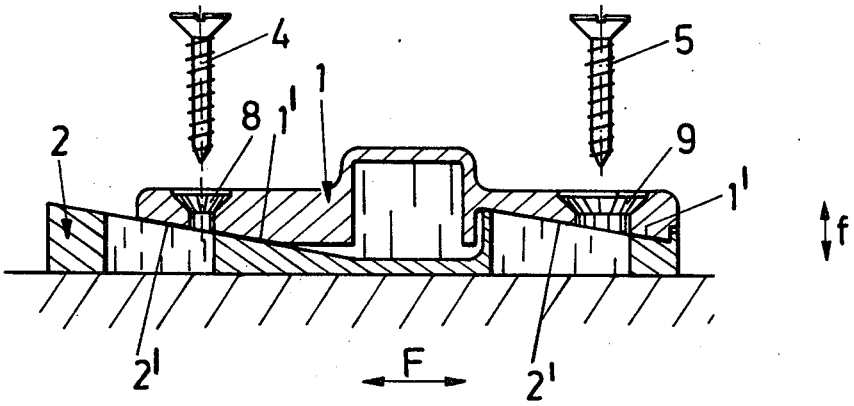
FIG. 3 is a sectional view taken along line A—A of FIG. 2, showing the mounting member on the side of the body being in one maximum position of adjustment.
Figure 4:
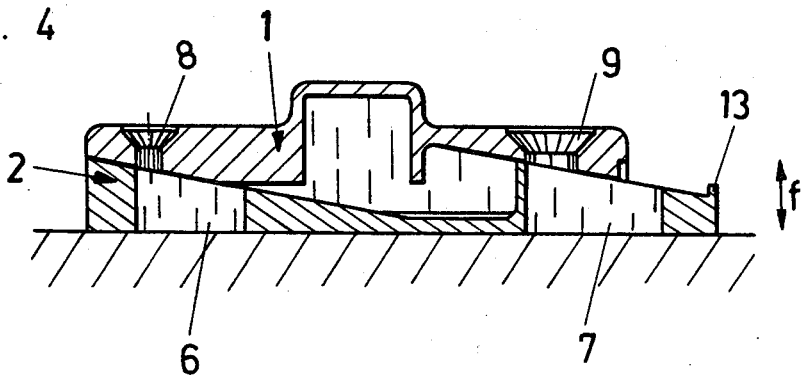
FIG. 4 is a view similar to FIG. 3, the mounting member on the side of the body being shown in the opposite maximum position.
Figure 6:
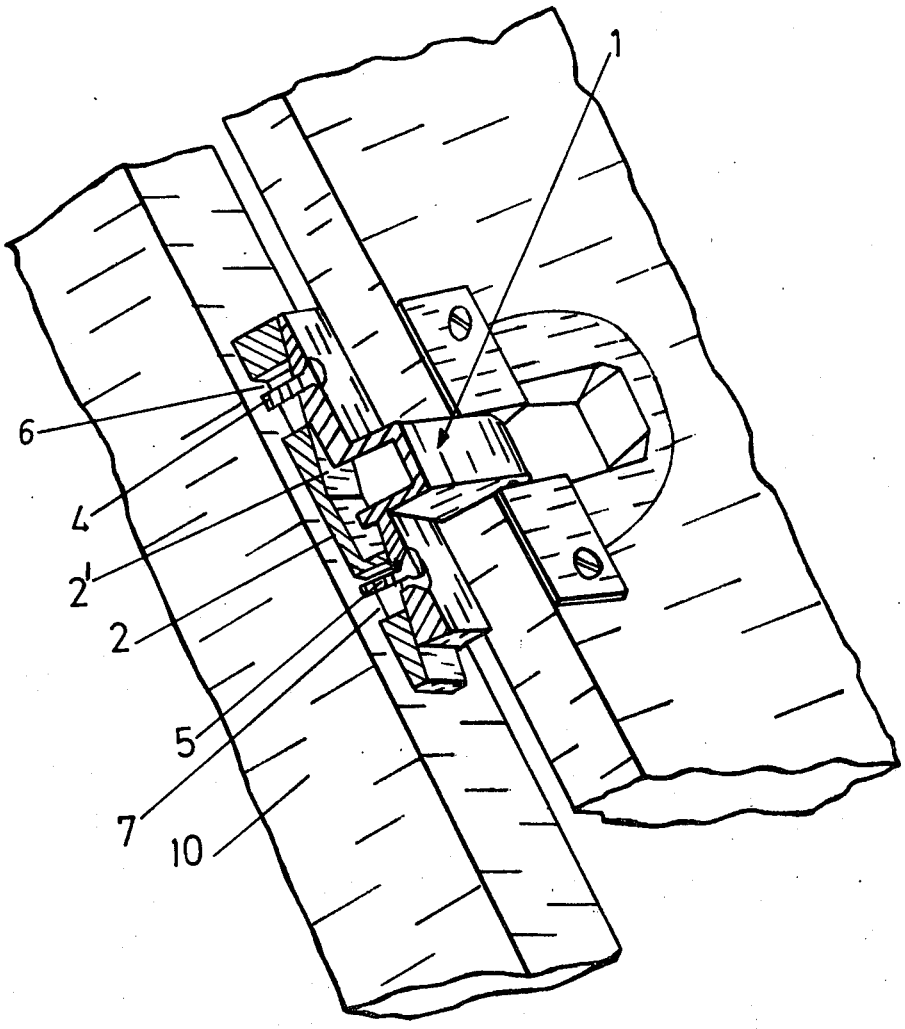
FIG. 6 is a perspective view of a hinge according to the invention, shown partly in section.

When the screw 4 extends through the round hole 8 and through the slot 6 and is screwed into the frame 10 of the body of the piece of furniture without clamping the mounting member 1 in position, the intermediate member 2 is displaceable in the direction of double arrow F over the length of the slot 6. The mounting member 1 is, however, fixed with respect to the height of the piece of furniture by the screw 4. When displacing the intermediate member 2, only an adjustment in the direction of the door joint is effected, which has been indicated in FIGS. 3 and 4 by the letter f.

After adjustment, the screw 4 and the screw 5 are fastened.

In the illustrated embodiment, the intermediate member 2 is at its two sided provided with projections 11 resting against the legs 12 of the mounting member 1.

In the illustrated embodiment, the intermediate member further has a stop 13 preventing the intermediate member 2 from escaping from below the mounting member 1.

What is claimed is:

1. In a hinge for pivotally mounting a door onto a body of an article of furniture, said hinge being of the type including a hinge casing adapted to be fastened to a door of an article of furniture, a mounting member adapted to be fastened to a body of the article of furniture, and at least one hinge link and at least one hinge axle connecting said hinge casing and said mounting member, the improvement comprising:

an intermediate member positionable between said mounting member and the body for adjusting the relative spacing therebetween;

said mounting member having therethrough a round hole and having a central length portion and two opposite end length portions;

said central length portion supporting said hinge axle to extend in a longitudinal direction;

said mounting member having at said two opposite end length portions two inclined wedge faces extending parallel to said longitudinal direction of said hinge axle;

said intermediate member having two inclined wedge faces extending parallel to said longitudinal direction of said hinge axle and in contact with respective said inclined wedge faces of said mounting member, such that displacement of said intermediate member with respect to said mounting member in opposite directions parallel to said longitudinal direction will change the relative spacing of said mounting member from the body;

a screw extending through said round hole and through said intermediate member; and said intermediate member having therethrough a slot elongated in a direction parallel to said longitudinal direction of said hinge axle, said screw extending through said slot, thereby enabling said displacement of said intermediate member with respect to said mounting member.

2. The improvement claimed in claim 1, wherein said round hole extends through one of said opposite end length portions of said mounting member, and further comprising a slot, elongated in a direction parallel to said longitudinal direction, extending through the other of said opposite end length portions, said intermediate member having therethrough a second slot elongated in a direction parallel to said longitudinal direction and aligned with said slot in said mounting member, and a second screw extending through said slot in said mounting member and said second slot in said intermediate member.

3. The improvement claimed in claim 2, wherein said two slots in said intermediate member extend through said inclined wedge faces thereof.

4. The improvement claimed in claim 2, wherein said screws are fastening screws for fixing said mounting member to the body.

5. The improvement claimed in claim 1, wherein said mounting member and said intermediate member each have an elongated generally rectangular configuration with respective longer sides extending in directions parallel to said longitudinal direction.

6. The improvement claimed in claim 5, wherein said mounting member has a generally U-shaped cross-sectional configuration embracing said intermediate member and with opposite longitudinal legs adjacent opposite said longer sides of said intermediate member.

7. The improvement claimed in claim 6, further comprising projections extending from said longer sides of said intermediate member for contacting respective said legs.

* * * * *